US006513429B1

(12) United States Patent
Krouse

(10) Patent No.: US 6,513,429 B1
(45) Date of Patent: Feb. 4, 2003

(54) ELASTIC BELT METERING DEVICE FOR A PRINTING PRESS

(75) Inventor: Charles Lambert Krouse, Madbury, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 27 days.

(21) Appl. No.: 09/716,693

(22) Filed: Nov. 20, 2000

(51) Int. Cl.[7] ..... B41F 31/06; B41F 31/16

(52) U.S. Cl. ..... 101/350.1; 101/349.1; 101/DIG. 33

(58) Field of Search ..... 101/364, 348, 101/349.1, DIG. 33, 350.1; 118/257, 106

(56) References Cited

U.S. PATENT DOCUMENTS

| | | | | | |
|---|---|---|---|---|---|
| 3,363,530 | A | * | 1/1968 | Rice | 396/605 |
| 4,016,812 | A | * | 4/1977 | Lauk et al. | 101/156 |
| 4,530,284 | A | * | 7/1985 | Fischer | 101/148 |
| 4,708,059 | A | | 11/1987 | Juenghans | 101/350 |
| 4,993,321 | A | | 2/1991 | Dennstedt | 101/350 |
| 5,880,818 | A | * | 3/1999 | Nishikawa | 355/27 |

FOREIGN PATENT DOCUMENTS

| | | | |
|---|---|---|---|
| CZ | 248128 | 1/1987 | B41F/31/16 |
| DE | 459469 | | 4/1928 |
| DE | 519889 | | 2/1931 |
| DE | 558045 | | 8/1932 |
| DE | 3516570 | | 11/1985 |
| DE | 3531433 | | 3/1987 |
| DE | 3939271 | | 6/1990 |
| GB | 280376 | | 11/1927 |
| GB | 2160820 | | 1/1986 |
| WO | 9938691 | | 8/1999 |
| WO | WO 0044563 | * | 8/2000 |

* cited by examiner

*Primary Examiner*—Daniel J. Colilla
(74) *Attorney, Agent, or Firm*—Davidson, Davidson & Kappel, LLC

(57) ABSTRACT

The present invention includes an inking or other solution unit having a first roll, a second roll, the second roll having a lower surface speed than the first roll, and an elastic belt running over the first roll and the second roll in a fixed length path during operation. The present invention also includes a method for inking or providing another solution to a printing cylinder comprising the steps of rotating a first roll at a first surface speed, rotating a second roll at a second surface speed, the first surface speed being greater than the second surface speed, moving an elastic belt over the first and second rolls, a path of the elastic belt maintaining a fixed length, and contacting the elastic belt with ink or another solution.

19 Claims, 3 Drawing Sheets

ELASTIC BELT METERING DEVICE FOR A PRINTING PRESS

BACKGROUND OF THE INVENTION

1. Field of the Invention

The present invention relates generally to printing presses and more particularly to a device and method for a providing ink or other solutions to a plate cylinder or image member of a printing press.

2. Background Information

Offset lithographic printing presses, for example, typically have a plate cylinder carrying an imaged plate. During printing, the plate is inked, and the inked image is transferred to a blanket which then contacts paper sheets or a continuous web of paper. Ink for the plate cylinder may be transferred from a fountain roll to an inker roll by a series of metering rolls and belts. From the inker roll the ink is transferred to the plate cylinder.

One way to meter ink from the fountain roll to the inker rolls is via ductor and slipping-nip metering rolls. However, the metering by ductor and slipping-nip metering rolls may result in a discontinuous ink transfer. Also, both ductor and metering rolls have gross slip between the roll surfaces during the transfer process.

Czechoslovakian Patent Document No. 248128 purports to disclose an inking apparatus with a flexible and elastic belt. Ink is applied to the flexible and elastic belt as a uniform and broad strip. Two tensioning rollers are connected to an automatic tension control, which the patent asserts move apart from each other to form a thinner ink layer or toward each other to form a thicker ink layer. A compacting roller contacts one of the tensioning rollers.

The device of the 248128 Czech Patent Document has the disadvantage that the tensioning rollers, compacting roller and device for automatic tension control require that a path of the belt be expanded or decreased to alter the ink thickness, as the automatic tension control varies a distance between the two tensioning rollers. The changing of the path length for a flexible elastic belt requires a complicated arrangement and might lead to increased belt failure. Moreover, the tensioning system is a complex arrangement requiring tensioning rollers and compacting roll to provide a sufficient tension in the elastic belt. In addition, it does not appear as though the surface speeds of the rollers of the Czech patent device vary.

BRIEF SUMMARY OF THE INVENTION

An object of the present invention is to provide for an accurate and reliable device and method for providing continuous ink or other solution metering for a printing press.

The present invention provides a device for providing ink or another solution to a printing press comprising at least one metering device, each metering device having:

- a first roll having a first surface speed;
- a second roll having a second surface speed lower than the first surface speed; and
- an elastic belt running in a fixed-length path over the first roll and the second roll.

The first roll has a higher surface speed than the second roll, and thus defines a high speed roll, while the second roll defines a low speed roll. The elastic belts are arranged such that each elastic belt rotates preferably around only one low speed roll and one high speed roll.

"Fixed-length path" as defined herein means that the belt path length does not essentially change as the belt traverses its path, although minor variations due to the stretching and contracting of the belt could occur.

With the elastic belt of the present invention, discontinuous ink transfer can be avoided. Also, the elastic belt avoids the gross slip between the roll surfaces that occurs sometime during the transfer process. Thus, the present invention provides the advantage of continuous non-slip ink metering. Moreover, the elasticity of the belt allows the differing surface speeds of the rolls to deform the elastic belt.

Preferably, the belt experiences no slip at either the first or second roll. The no-slip contact results in more consistent printing. "No slip" as defined herein means that although a micro-creep may occur, the belt does not slip to as to significantly alter the speed of the belt with respect to the surface speed of the roll.

Each metering device may be arranged so that it may contact another elastic belt at a nip.

Preferably, the elastic belts have an ink film on the outer surface. The thickness of the ink film has an inverse relationship to the amount of strain in the elastic belt.

The elastic belts elongate and become thinner on exiting the roll with the lower surface speed, and compress and thicken on exiting the roll with the higher surface speed. The change in the elastic belt provides the advantage of allowing the elastic belts to deform in response to stress produced by the differing speeds of the rolls. Furthermore, the deformation of the elastic belts changes the surface area of the elastic belt, causing the thickness of the ink film to change and affecting the distribution of the ink on subsequent devices. Because the rolls have different surface speeds, the surface speed of the elastic belts varies.

The radius of the second roll is preferably, but not necessarily, smaller than the radius of first roll. The differing radii provide the advantage of changing the surface speeds of the rolls, which in turn affects the deformation of the elastic belt. The rolls may then have the same rotational speed, which can provide for simpler gearing mechanisms, e.g., 1-to-1. Equal sized rollers could also be used if driven at different rotational speeds.

The present invention may include a fountain roll that contacts one of the low speed rolls, so as to form a nip with one of the first and second rolls. The fountain roll provides the advantage of allowing the ink film to be transferred to the elastic belt.

The present invention may also comprise an inker roll that contacts one of the rolls, so as to form a nip. Also, the present invention may include a print cylinder, such as a plate cylinder, that may contact the inker roll, so as to form a nip.

The present invention also includes a method for inking or providing another solution to a cylinder comprising the steps of:

- rotating a first roll at a first surface speed;
- rotating a second roll at a second surface speed, the second surface speed being less than the first surface speed;
- moving an elastic belt over the first and second rolls, the elastic belt maintaining a fixed path length; and
- contacting the belt with ink.

The first and second rolls preferably are driven rolls.

The present invention also provides a device for providing ink or another solution in a printing press comprising:

- a first roll driven a first surface speed;
- a second roll driven at a second surface speed lower than the first surface speed; and an elastic belt running over the first roll and the second roll so as to define a first belt section between the first roll and the second roll and a second belt section between the first roll and the second roll opposite the first belt section, the first belt section being thinner than the second belt section.

In addition to use as an ink metering device, the present invention could also be used for applying dampening solution or other liquids distributed to a cylinder in a printing press.

BRIEF DESCRIPTION OF THE DRAWINGS

Preferred embodiments of the present invention are described below by reference to the following drawings, in which.

DETAILED DESCRIPTION

Figure 1:
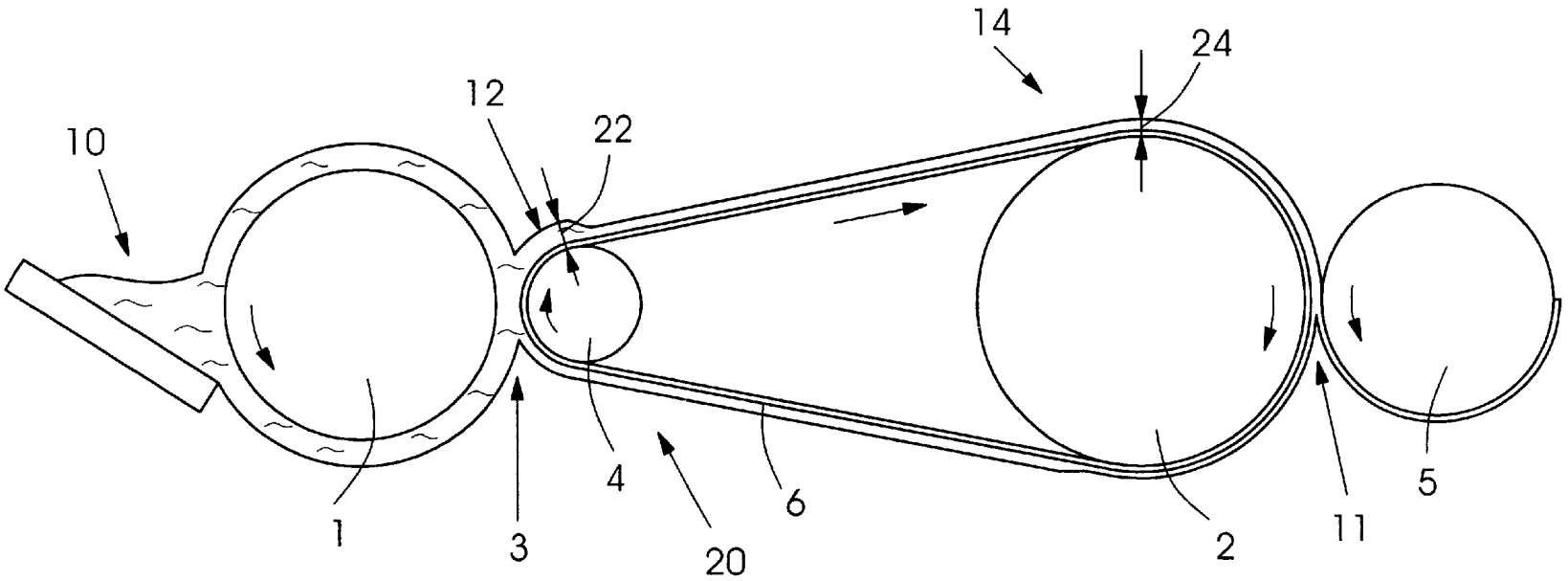
FIG. 1 shows a side view of a first embodiment of an ink metering device according to the present invention.

FIG. 1 shows a side view of a first embodiment of a metering device according to the present invention. A fountain roll 1 can receive ink from an ink fountain 10, and transfer the ink to a belt 6 on roll 4. Elastic belt 6 travels about roll 4 and another roll 2, preferably in a no-slip fashion. Roll 4 has a lower surface speed and smaller radius than the first roll 2. A low speed ink film 12 is transferred by the fountain roll 1 to the outer surface of the elastic belt 6 at a nip 3. As the elastic belt 6 exits the wrap of the second roll 4, the higher surface speed of first roll 2 increases the surface speed of the elastic belt 6, creating a high speed portion or area 14 of the elastic belt 6. The thickness of the high speed portion 14 of the elastic belt 6 decreases and the ink film 12 thins in response to the increase in surface speed.

The rolls 4 and 2 may be driven by a single motor, for example roll 4 being directly driven by a shaft of the motor and roll 2 being geared to the motor shaft. Alternately, each roll 2 and 4 can be driven by a different motor.

The ink then may be transferred to an inker roll 5 at a nip 11.

As the elastic belt 6 exits the wrap of the first roll 2, the second roll 4 decreases the surface speed of the elastic belt 6, creating a low speed portion or area 20. The thickness of the low speed portion 20 of the elastic belt 6 increases and any remaining ink film 12 thickens, in response to the decrease in speed.

Assuming that there is sufficient preload strain to avoid a slack belt, that the belt is elastic, that there is no lateral strain, that the ink is incompressible, that there is ink "instant" leveling, that there is no slip on the rolls, and that the mechanism is in a steady state, then the following equation holds true: $V_s/1+\in_s=V_f/1+\in_f$, where $V_s$ is the surface speed for the low speed portion 20, $V_f$ is the surface speed for the high speed portion 14, $\in_s$ is the strain constant for the low speed portion 20, and $\in_f$ is the strain constant for the high speed portion 14. From the equation, a ratio constant can be determined that is equal to 1 plus the strain constant for the high speed portion 14, divided by 1 plus the strain constant for the low speed portion 20, i.e., $=1+\in_f/1+\in_s$. The ratio constant is also equal to the surface speed of the high speed portion 14 divided by the surface speed for the low speed portion 20, i.e., $=V_f/V_s$. Furthermore, a low speed thickness 22 of the ink film 12 multiplied by the surface speed of the low speed portion 20 is equal to a high speed thickness 24 of the ink film 12 multiplied by the surface speed of the high speed portion 14, i.e., $h_sV_s=h_fV_f$. Thus, the high speed thickness 24 is equal to the low speed thickness 22 divided by the ratio constant, i.e., $h_f=h_s/$ . Conversely, the low speed thickness 22 is equal to the high speed thickness 24 multiplied by the ratio constant, i.e., $h_s= h_f$. In brief, the thickness of the ink film decreases proportionally to an increase in surface speed and increases proportionally to a decrease in surface speed; moreover, the proportional increase or decrease bears a relationship to the elastic strain constants for the elastic belt.

Figure 2:
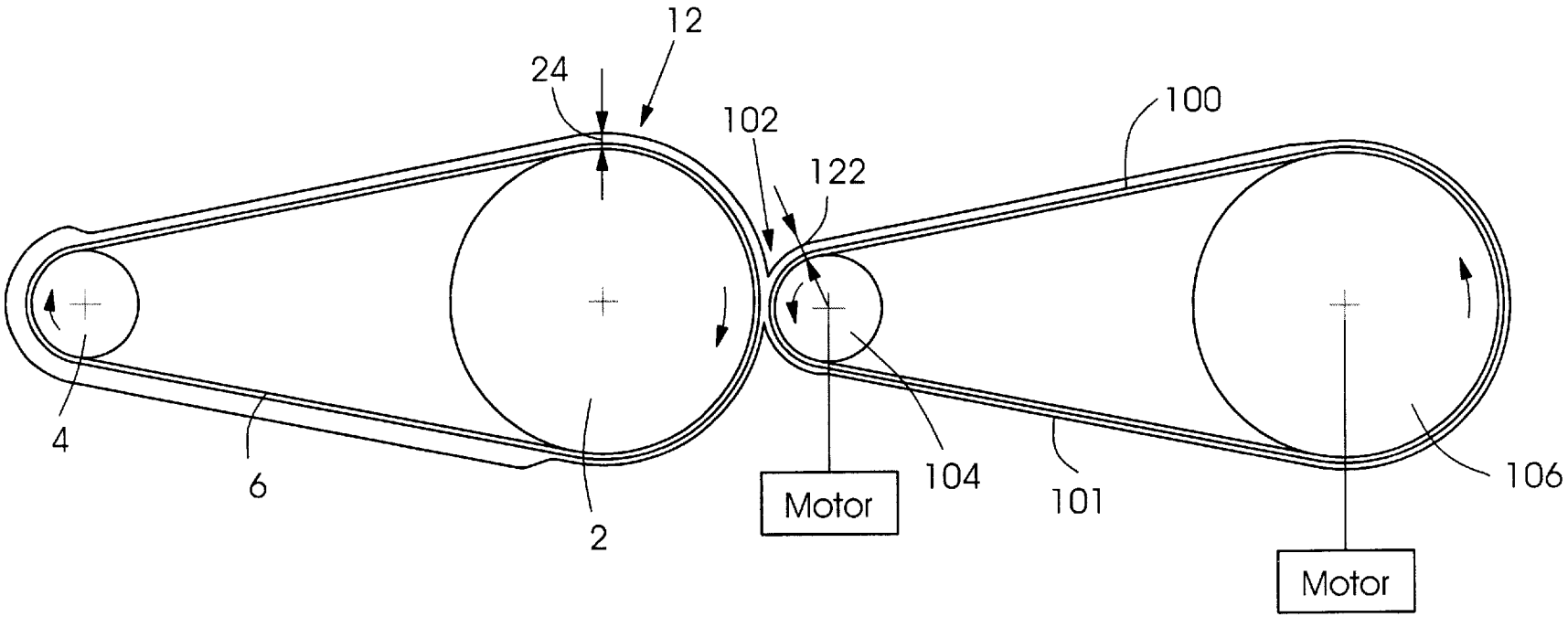
FIG. 2 shows a side view of an ink metering device according to a second embodiment having a series combination.

FIG. 2 shows two metering belts, which are in series combination and which can provide even thinner ink films to an inker roll. The elastic belt 6 of the first embodiment may contact a second elastic belt 100 at an elastic belt contact nip 102 formed by the first roll 2 and another second roll 104. The rotation of the first roll 2 and the second roll 4 drives the elastic belt 6 in a clockwise direction and the rotation of another first roll 106 and the other second roll 104 drives the second elastic belt 100 in a direction opposite the direction of the elastic belt 6, i.e. counter-clockwise. The ink film 12 is transferred from the elastic belt 6 to the second elastic belt 100 at the elastic belt contact nip 102. When the surface speeds are equal, when there is no slip on the nip, and when the ink film is split 50/50, the thickness of the ink film at the elastic belt contact nip 102 is equal to one-half the high speed thickness 24 of the ink film 12 on the elastic belt 12 plus a second low speed thickness 122 of the ink film 12 on the second elastic belt 100, i.e., $T=\frac{1}{2}(h_s+h_f)$. The resulting ink film 101 is then transferred to the high speed roll 106 and thinned by belt 100 in a similar manner as by belt 6. At the second high speed roll 106 the ink may be transferred for example to a inker roll or yet another belt.

Figure 3:
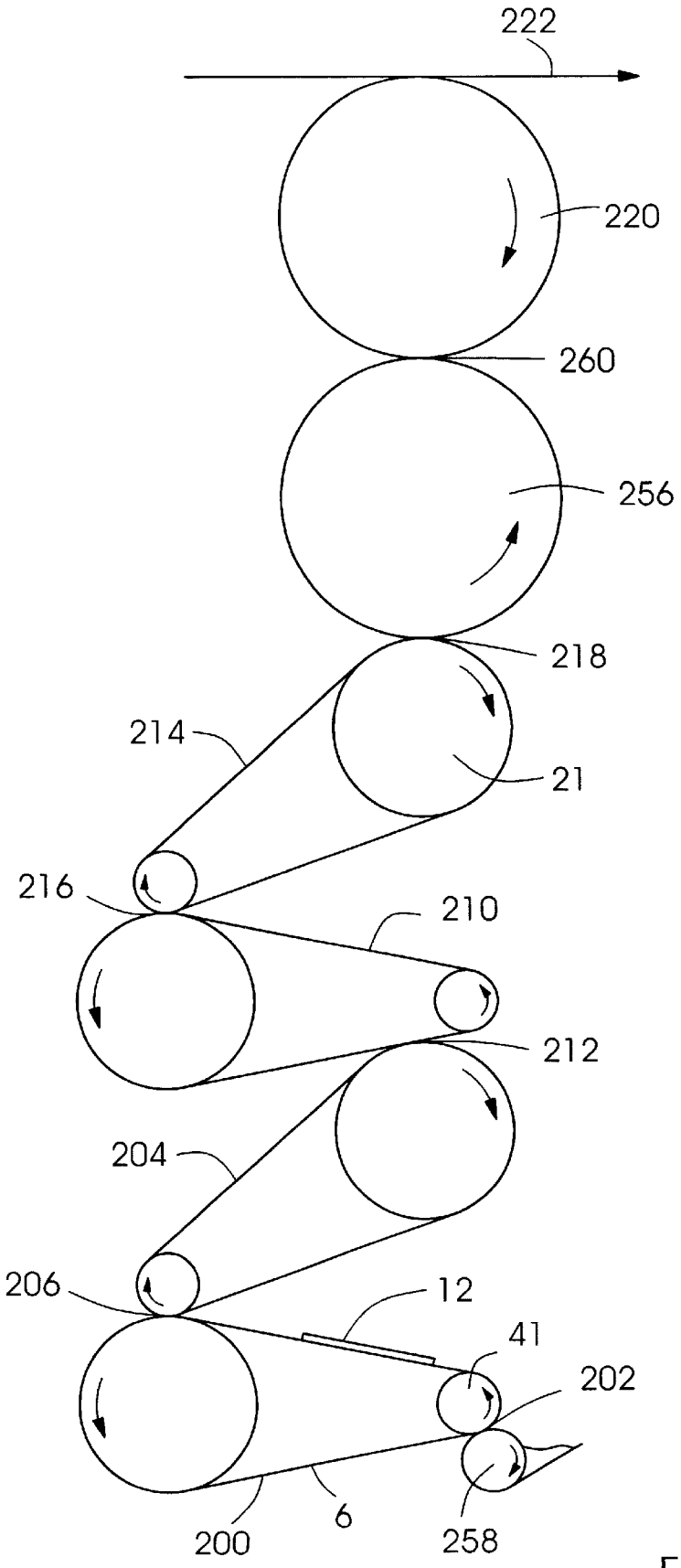
FIG. 3 shows a side view of yet another embodiment in which four belts are in series combination.

FIG. 3 shows a side view of four metering belts 6, as shown in FIG. 1, which are in series combination. A fountain roll 258 may transfer ink to a first metering belt 200 at a first nip 202 formed by a slower speed roll 41 to form the ink film 12. The ink film 12 is then transferred to a second metering belt 204 at a second nip 206, in the same manner as described in FIG. 2. Next, the ink film 12 is transferred to a third metering belt 210 at a third contact nip 212, in the same manner as described in FIG. 2. The ink film 12 is then transferred to a fourth metering belt 214 at a fourth nip 216, in the same manner as described in FIG. 2. At a fifth nip 218 formed by a higher speed roll 21 of the fourth metering belt 214 and a plate cylinder 256, the ink film 12 may be transferred to the plate cylinder 256. From the plate cylinder 256, which may be for a lithographic offset printing press unit, the inked image may be transferred to a blanket cylinder 220 at a nip 260 formed by the plate cylinder 256 and the blanket cylinder 220. The blanket cylinder 220 may then transfer the image to a web 222 of printable material, e.g., paper. The nips 202, 206, 212, 216, 218, 260 can be no-slip contact nips.

Each of the elastic belts 6, including belts 200, 204, 210, 214, rotate in opposite directions to one another. For example, the elastic belt 200 may rotate counter-clockwise, the elastic belt 204 may rotate clockwise, the belt 210 may rotate counter-clockwise, and the elastic belt 214 may rotate clockwise. The fountain roll 258 may rotate opposite the rotation of belt 200, e.g., clockwise. The plate cylinder 256 may rotate opposite the rotation of the belt 214, for example, counter-clockwise, and the blanket cylinder 220 may rotate opposite the inker roll 256, for example, clockwise.

A radius ratio can be determined for each of the metering belt devices by dividing the first roll 2 radius by the second roll 4 radius, i.e., $=r_f r_s$. Assuming the radius ratio is the same for all the metering devices and the rotational velocities of the second rolls and the first rolls for each of the belts 200, 204, 210, 214 are the same, then the thickness of the ink film 12 at the fountain roll 258 can be calculated by the following equation: $T_0=(8\ ^4)T_p$, where $T_0$ is the thickness of the ink on the fountain roll 258, is the radius ratio, and $T_p$ is the thickness of the ink film 12 at web 222. Also, the surface speed of the ink film 12 can be calculated by the following equation: $V_0=(\ )^{-4}V_p$, where $V_0$ is the surface speed of the fountain roll 258, is the radius ratio, and $V_p$ is the press speed. In essence, the surface speed of the ink film 12 increases and the thickness of the ink film 12 decreases as the number of metering devices that the ink film passes through increases.

What is claimed is:

1. A device for providing ink or other solution comprising:

a first roll;

a second roll, the second roll having a lower surface speed than the first roll; and an elastic belt running over the first roll and the second roll in a fixed length path during operation, the elastic belt passing through a first belt area between the first roll and the second roll and a second belt area between the first roll and the second roll opposite the first belt area, the elastic belt being thinner when in the first belt area than in the second belt area.

2. The device as recited in claim 1 wherein the elastic belt contacts the first roll in a contact area, the elastic belt having a same surface speed in the contact area as a surface speed of the first roll.

3. The device as recited in claim 1 further comprising a second elastic belt, the elastic belt contacting the second elastic belt.

4. The device as recited in claim 1 wherein the elastic belt contacts the second roll in a contact area, the elastic belt having a same surface speed in the contact area as the second roll.

5. The device as recited in claim 4 wherein the elastic belt contacts the first roll in a second contact area, the elastic belt having a same surface speed in the second contact area as the first roll.

6. The device as recited in claim 1 wherein a second radius of the second roll is less than a first radius of the first roll.

7. The device as recited in claim 1 further comprising an ink film, the ink film being located on an outer surface of the elastic belt.

8. The device as recited in claim 7 wherein the ink film is thinner in the first belt area than in the second belt area.

9. The device as recited in claim 1 further comprising a fountain roll that contacts the belt at the second roll.

10. The device as recited in claim 1 further comprising an inker roll that contacts the belt at the first roll.

11. The device as recited in claim 1 further comprising a plate cylinder contacting the belt at the first roll.

12. The device as recited in claim 1 further comprising a second elastic belt contacting the elastic belt and a third elastic belt contacting the second elastic belt.

13. The device as recited in claim 1 wherein the first and second rolls are driven rolls.

14. The device as recited in claim 1 wherein the device is an inking unit.

15. A method for inking or providing another solution to a printing cylinder comprising the steps of:

rotating a first roll at a first surface speed;

rotating a second roll at a second surface speed, the first surface speed being greater than the second surface speed;

moving an elastic belt over the first and second rolls, the elastic belt passing through a first belt area between the first roll and the second roll and a second belt area between the first roll and the second roll opposite the first belt area, the elastic belt being thinner when in the first belt area than in the second belt area, a path of the elastic belt maintaining a fixed length; and contacting the elastic belt with ink or another solution.

16. The method as recited in claim 15 further comprising contacting the elastic belt with a second elastic belt.

17. The method as recited in claim 15 wherein the rotating the first roll step includes driving the first roll and the rotating the second roll step including driving the second roll.

18. The method as recited in claim 15 wherein the contacting step includes providing ink to the belt.

19. A device for providing ink or another solution in a printing press comprising:

a first roll driven by a motor at a first surface speed;

a second roll driven by the motor or another motor at a second surface speed lower than the first surface speed; and an elastic belt running over the first roll and the second roll so as to define a first belt area between the first roll and the second roll and a second belt area between the first roll and the second roll opposite the first belt area, the elastic belt passing through the first belt area and the second belt area, the elastic belt being thinner when in the first belt area than in the second belt area.

* * * * *